US005305478A

United States Patent [19]

Potter, Jr.

[11] Patent Number: 5,305,478

[45] Date of Patent: Apr. 26, 1994

[54] ECOLOGY SINK

[75] Inventor: Edwin R. Potter, Jr., Howards Grove, Wis.

[73] Assignee: Kohler Co., Kohler, Wis.

[21] Appl. No.: 19,399

[22] Filed: Feb. 18, 1993

[51] Int. Cl.[5] ..... E03C 1/00

[52] U.S. Cl. ..... 4/629; 4/640; 248/145; 312/228; 312/326

[58] Field of Search ..... 4/467, 474–478, 4/485, 486, 627, 629, 638, 639, 640, 642, 644, 645, 647, 648; 248/131, 132, 145; 312/228, 273, 310, 326

[56] References Cited

U.S. PATENT DOCUMENTS

| | | | |
|---|---|---|---|
| 330,892 | 11/1885 | Greene | 4/627 |
| 455,072 | 6/1891 | Thourot | 4/640 |
| 593,472 | 11/1897 | Hedges | 16/233 |
| 635,368 | 10/1899 | Arnold | 16/233 |
| 1,207,598 | 12/1916 | Moon | 248/145 |
| 1,288,013 | 12/1918 | Jensen | 4/693 |
| 1,602,261 | 10/1926 | Hill | 4/629 X |
| 1,635,361 | 7/1927 | Fuson | 4/629 |
| 1,765,267 | 6/1930 | Hartman | 4/629 |
| 1,830,781 | 11/1931 | Brotz | 4/629 X |
| 1,875,813 | 9/1932 | Kaplan et al. | 4/638 X |
| 1,961,922 | 6/1934 | Brandstetter | 248/145 X |
| 2,036,692 | 4/1936 | Groeniger | 4/640 |
| 2,067,983 | 1/1937 | Rice | 248/145 |
| 2,113,677 | 4/1938 | Carroll | 16/233 X |
| 2,116,253 | 5/1938 | Van Buren | 4/467 |
| 2,172,188 | 9/1939 | Cather | 4/629 |
| 2,317,693 | 4/1943 | Nyboer | 4/629 |
| 2,498,502 | 2/1950 | O'Brien | 4/629 |
| 2,524,204 | 10/1950 | O'Brien | 4/629 |
| 3,314,082 | 4/1967 | Minella | 4/640 X |
| 3,642,145 | 2/1972 | Shelton | 248/131 X |
| 4,689,840 | 9/1987 | Muck et al. | 4/629 |
| 4,813,087 | 3/1989 | Sperka et al. | 4/629 |
| 4,847,927 | 7/1989 | Blanc | 4/629 |
| 5,073,997 | 12/1991 | Rabe | 4/629 |

*Primary Examiner*—Robert M. Fetsuga
*Attorney, Agent, or Firm*—Quarles & Brady

[57] ABSTRACT

A waste storage and removal assembly for use with a waste chute under a sink wherein a carrier for a waste container is pivoted from positions outside and under the sink as well as raised and lowered in conjunction with a sealing member of the waste chute. The waste removal assembly is easily connected to a sink cabinet beneath the sink and is entirely accommodated therein so that no portion is visible when the waste container is stored thereunder. In an especially preferred form, the waste assembly is particularly suited for use with a chute connected to a saddle portion of a two basin sink which also has a drain control in the saddle.

13 Claims, 5 Drawing Sheets

FIG. 1
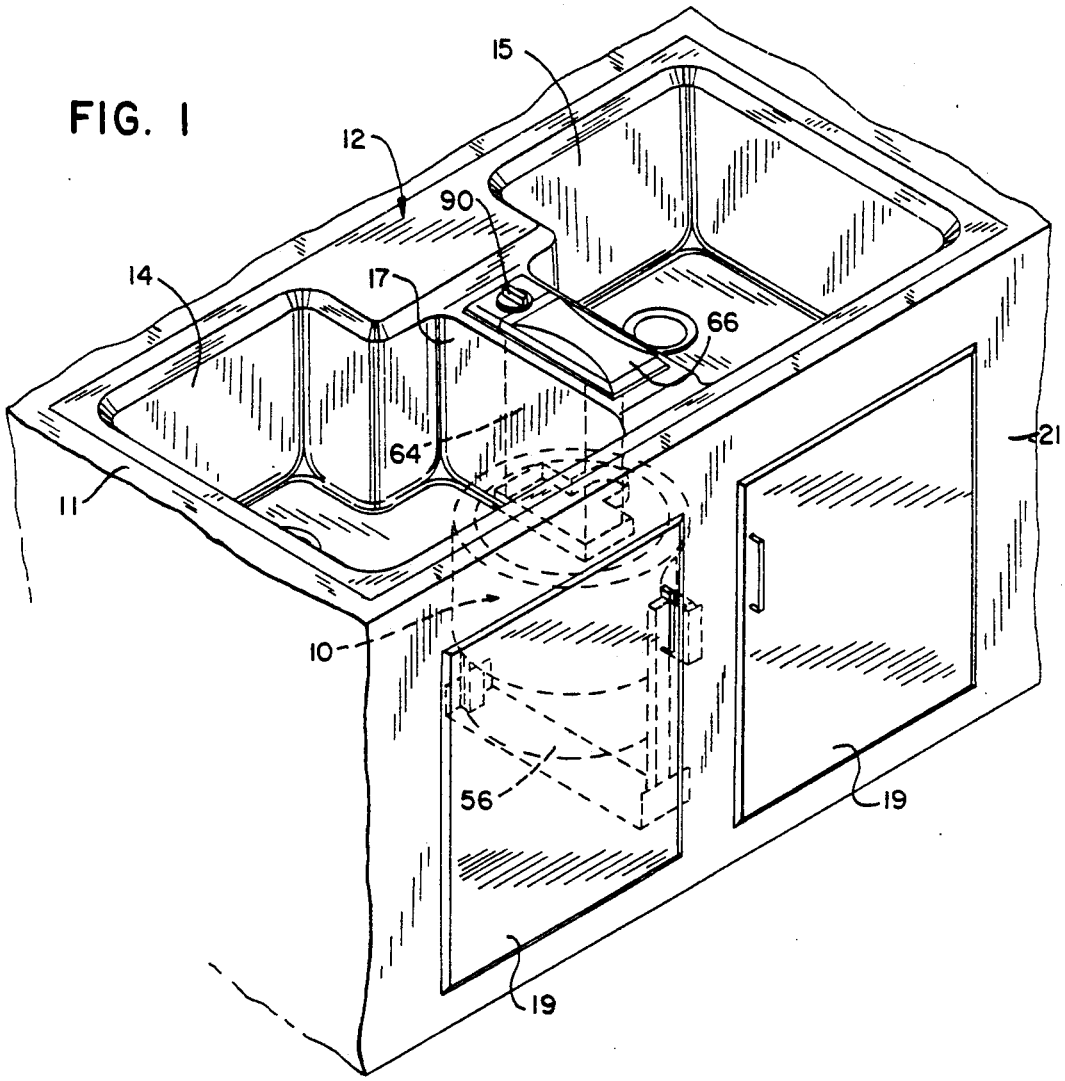
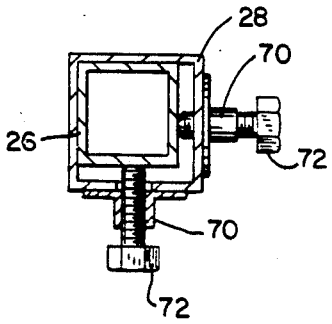
FIG. 7

FIG. 3
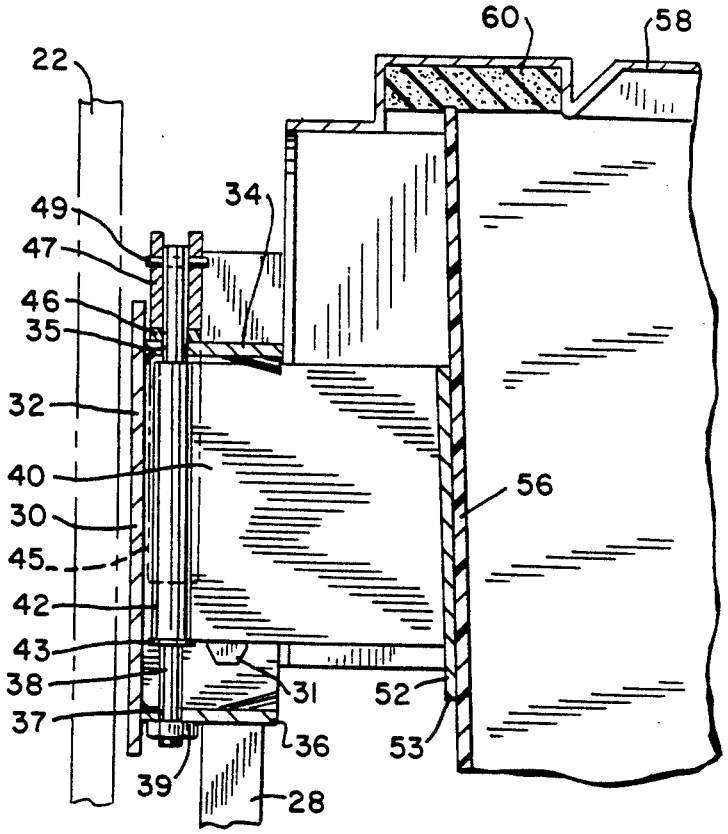
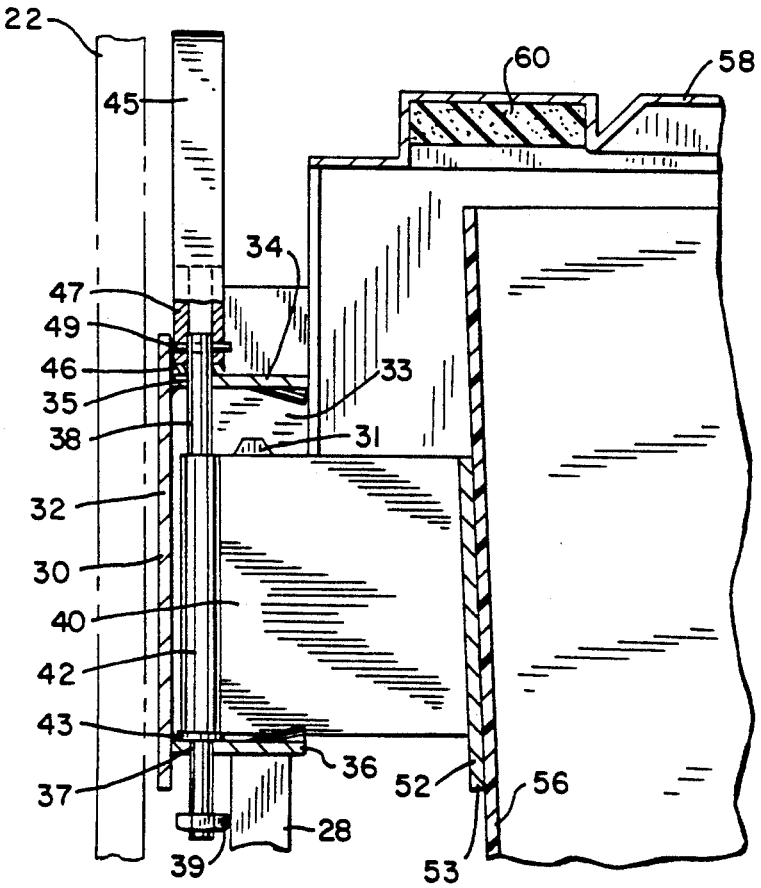
FIG. 4

FIG. 5
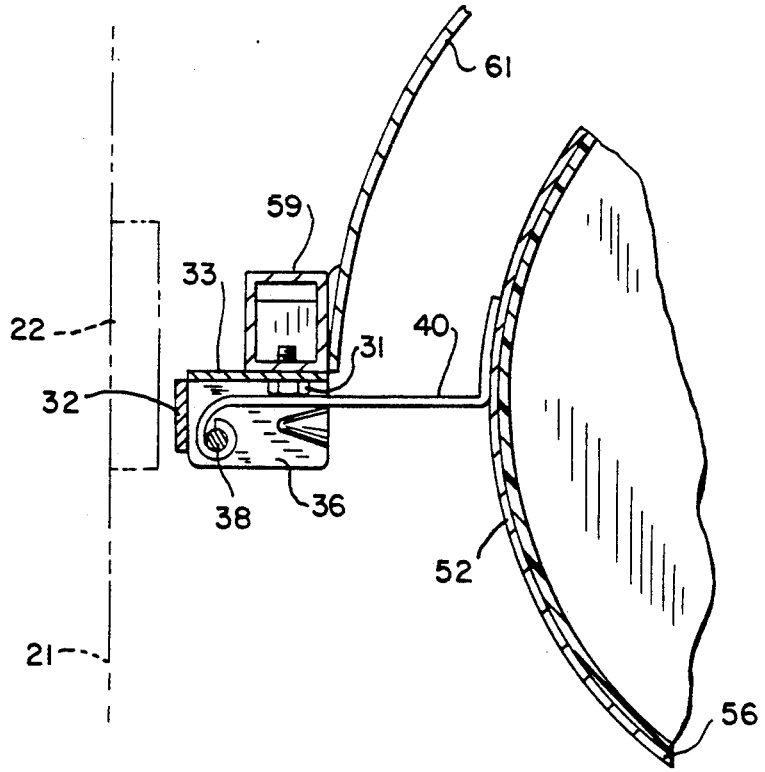
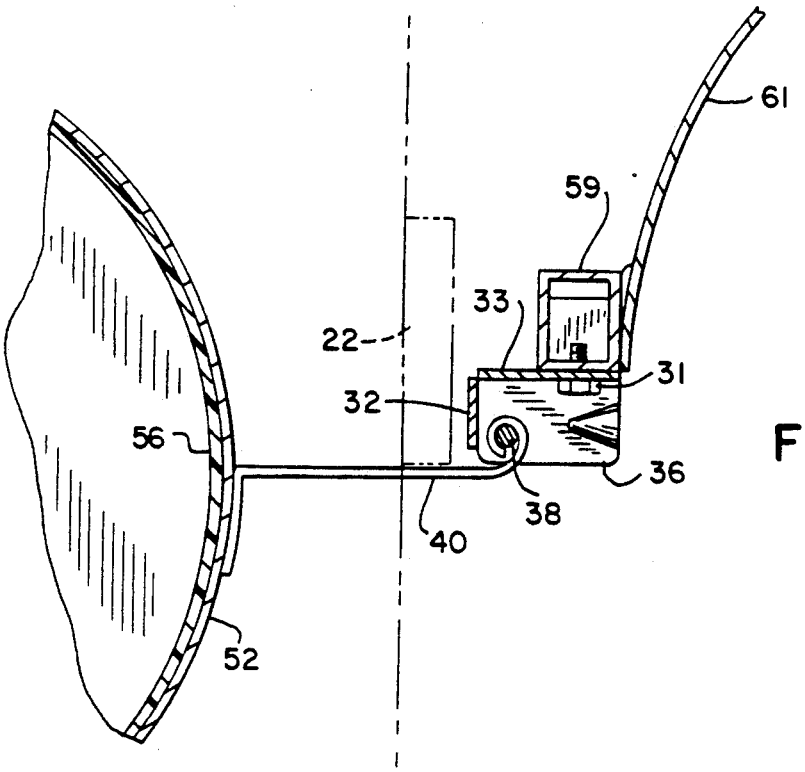
FIG. 6

ECOLOGY SINK

BACKGROUND OF THE INVENTION

1. Field of the Invention

This invention relates to sinks which provide for temporary storage of items to be recycled.

2. Description of the Prior Art

Concerns for the environment have placed new demands on the disposal of garbage. The use of waste removal systems which provide for the storage of recyclable items in a receptacle in conjunction with a sink are well known. For example, in U.S. Pat. Nos. 1,635,361 and 4,689,840 there are disclosed guide rail systems for waste containers. Systems for pivoting waste containers inwardly and outwardly from under sinks are also well known. These are shown in U.S. Pat. Nos. 330,892; 1,207,598; 1,830,781; 2,067,983; and 2,172,188.

A problem with such systems is odor. In addition to providing movement of a waste container inwardly and outwardly from under a sink, a movement system should be capable of also providing a tight seal between the waste container and a waste chute. Moreover, when removal is desired, it should be easy to access the recyclables. Such a system should also be operable with the fewest component parts. Further, it should be easy to install and repair.

In keeping with aesthetic objectives, it is also preferable that all component parts be hidden from view when a container utilized in conjunction with the system is not being emptied. It is also desirable that the sink be of as compact a size as possible.

SUMMARY OF THE INVENTION

In one form the invention provides a waste storage assembly for use with a waste chute that is disposed under a sink. The assembly includes a waste storage container having an upper lip. There is a pintle and means for pivoting the container around the pintle from a position where the container is directly under the chute to a second position where it is not. There is also a cam which is operationally linked to the pintle to move the pintle along its longitudinal axis. The axial movement of the pintle moves the container lip from a position in sealing engagement with the waste chute down to a lower position where the container may be pivoted around the pintle.

In another form, the invention provides a waste removal assembly for use with a waste chute disposed under a sink, the waste chute having a sealing member. There is a first hinge member adapted to be connected to a frame structure. The first and second hinge members are axially aligned with a pintle, and the second hinge member is connected to the pintle in a rotatable manner. A bearing surface is provided in conjunction with the first hinge member. A cam member is connected to the pintle and has a camming surface operatively positioned on the bearing surface. A support member for a waste container is connected to the second hinge member. The waste container can be pivoted from positions outside and under the sink by means of the second hinge member as well as raised and lowered by means of the second hinge member and the cam member in conjunction with the sealing member of the waste chute.

In a preferred form, the frame structure is self supporting of the hinge members and the cam member and is adapted to be secured in a sink cabinet.

In another preferred embodiment, the waste removal assembly is connected to a waste chute disposed under the sink with the waste chute connected to a sealing member.

In yet another preferred form, the waste chute is connected to a saddle section between two sink basins, and a drain control assembly is also connected thereto.

It is therefore a principal object of the invention to provide a waste removal unit for a sink which affords ease of operation as well as a tight seal with a disposal chute.

It is another object of the invention to provide a waste removal unit of the foregoing type which is completely hidden until access to the waste container is desired.

It is another object of this invention to provide a waste removal unit of the foregoing type which employs a minimum number of parts and can be produced without special tooling.

It is another object of the invention to provide a waste removal unit of the foregoing type which is easily installed, adjusted and repaired.

It is another object of the invention to provide a waste removal unit of the foregoing type which is of a rugged construction.

It is another object of the invention to provide a waste removal unit of the foregoing type which is designed to be used in conjunction with a waste chute connected to a sink saddle section to which is also connected a drain control.

The foregoing and other objects and advantages of the invention will appear in the following detailed description. In the description, reference is made to the accompanying drawings which show, by way of illustration and not limitation, a preferred embodiment of the invention.

DESCRIPTION OF THE DRAWINGS

FIG. 1 is a perspective view of sink showing a waste storage assembly of the present invention in broken lines;

FIG. 3 is a sectional view taken along line 3—3 of FIG. 2 and showing the waste container in a raised position;

FIG. 4 is a view similar to FIG. 3, albeit showing the waste container in a lowered position;

FIG. 5 is a sectional view taken along line 5—5 of FIG. 2;

FIG. 6 is a view similar to FIG. 5, albeit illustrating the waste container pivoted to a position outside the sink;

FIG. 7 is a sectional view taken along line 7—7 of FIG. 2; and

DETAILED DESCRIPTION OF THE PREFERRED EMBODIMENTS

Figure 2:
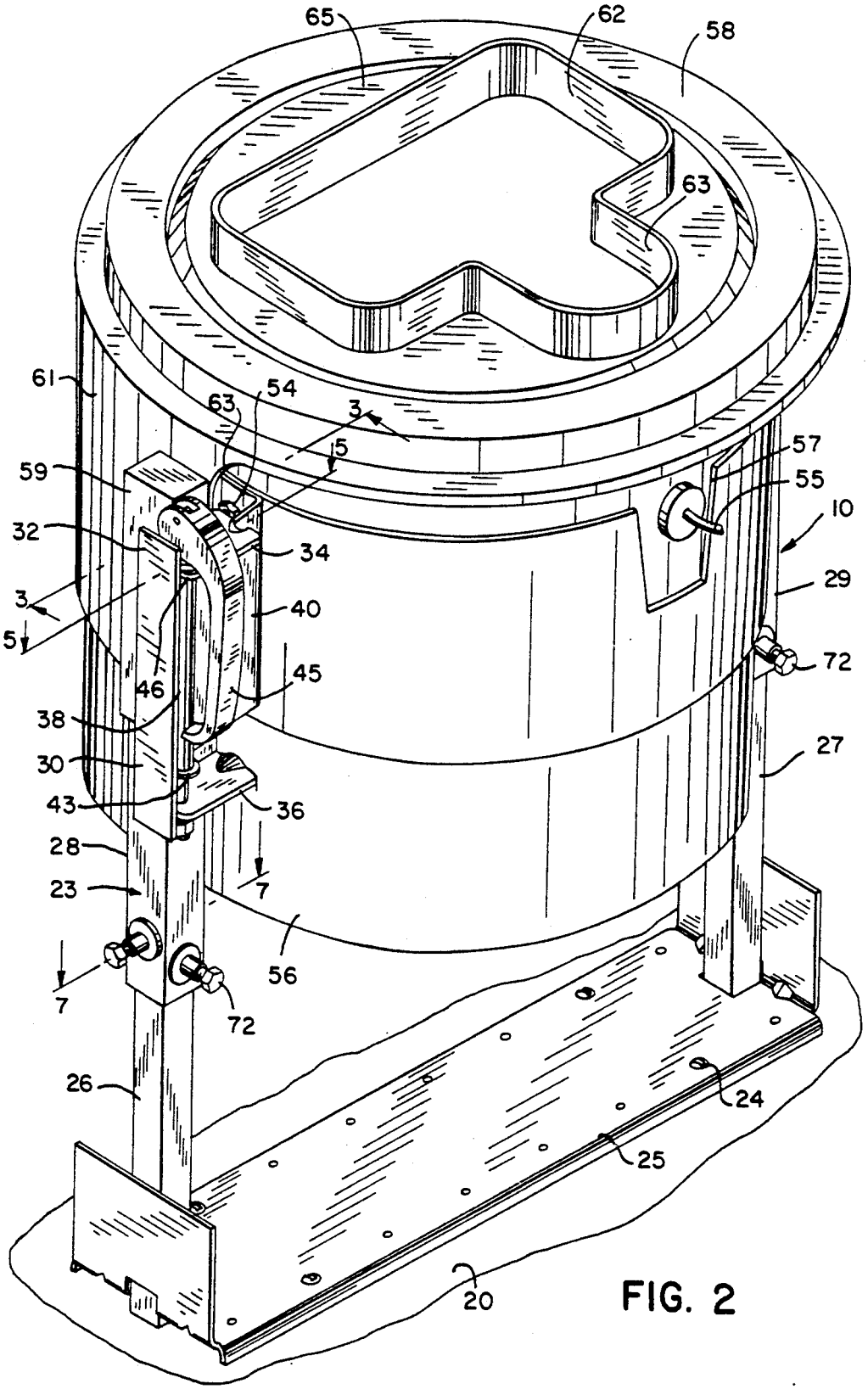
FIG. 2 is an enlarged perspective view of the waste storage assembly.

Referring to FIG. 1, a waste storage and removal assembly generally 10 is shown in conjunction with a sink generally 12 mounted on a cabinet 11. The sink has two basins 14 and 15, with a saddle portion 17 in between. The cabinet 11 has the usual front wall 21 with doors 19 therein.

Referring to FIGS. 2, 3 and 4, the waste storage and removal assembly 10 includes a frame generally 23 composed of a base 25 from which extend two lower legs 26 and 27 and two upper legs 28 and 29. Base 25 is attached to the floor 20 of the sink cabinet 11 by the screws 24. A hinge member 30 is attached to upper leg 28 such as by the bolts 31 and includes a side plate 33, an end plate 32, as well as upper and lower plates 34 and 36. There are passages 35 and 37 in the respective upper and lower hinge plates 34 and 36 for the passage of a pintle 38. As best seen in FIG. 4, one end of the pintle is positioned between the bifurcated jaws 47 of a cam arm member 45, with a pin 49 providing the pivotal connection. At the opposite end of the pintle is a retaining nut 39.

Positioned in a pivotal manner on the pintle 38 is a movable hinge member 40 having a hinge loop 42 formed from one continuous portion of material surrounding the pintle 38. Upward and downward movement of the hinge member 40 is restrained over the pintle 38 by means of the "E" clip 43 which will engage the pintle. Connected to the movable hinge 40 is a carrier ring 52 which is secured thereto such as by means of the bolts such as 54. Carrier or support member 52 is in the form of an annular collar and has an open bottom which receives a waste bucket 56 in a nesting manner by means of the tapered side wall 53. As seen in FIG. 2, carrier member 52 has opposing slots, one of which is shown at 57 to accommodate handle 55 of container 56 which can be of various sizes.

As best seen in FIGS. 2 and 3, there is a hood member 58 which is connected to leg 28 by attachment member 59 and bolts 31. Hood member 58 includes a skirt portion 61 (see FIG. 2) with a cut-a-way portion 63 to accommodate the carrier member 52. Hood member 58 has an opening 62 in the top portion 65 for tightly mating with a waste chute 64 which is seen in FIG. 1. It also has a seal member 60 (see FIG. 3) for contact with bucket 56. In addition, hood member 58 has an opening 63 (see FIG. 2) for placement of an odor absorbing wad of material (such as a packet of charcoal) which can be placed near the top of the waste bucket. As also seen in FIG. 1, there is a removable cover 66 placed over the chute 64.

Referring specifically to FIGS. 3 and 4, it is seen that the movable hinge member 40 can be moved from an upward position as shown in FIG. 3 to a downward position as shown in FIG. 4. This movement is effected by the movement of the cam arm 45, and the cam jaws 47 moving over wear member 46.

As seen in FIG. 3, the cam arm 45 is in a downward position so as to effect an upward movement of the pintle 38. This movement moves the carrier 52 as well as the bucket 56 upwardly and against the seal member 60. In order to disengage the bucket 56 with the seal member 60, the cam arm 45 is moved to an upward position as shown in FIG. 4 which moves the pintle 38 downwardly as well as the hinge member 40.

FIGS. 5 and 6 demonstrate the pivotal action of the movable hinge 40. In FIG. 5, the carrier 52 and waste bucket 56 are positioned under the hood 58. In FIG. 6, the hinge member 40 has been pivoted 180° so as to extend the carrier 52 and the waste bucket 56 outwardly from the front wall 21 of the sink 12. The cabinet frame 22 provides a stop for hinge 40 when the bucket 56 is moved outwardly from the sink as do the bolts 31 when it is moved inwardly. It should be pointed out in conjunction with FIGS. 5 and 6 that the pivotal motion of the hinge member 40 would be effected when the hinge member is in the down position as shown in FIG. 4.

FIG. 7 shows an adjustment feature for the legs of the frame 23. There it is seen that the adjustment can be made by the two bolts 72 passing through the threaded collars 70.

Figure 8:
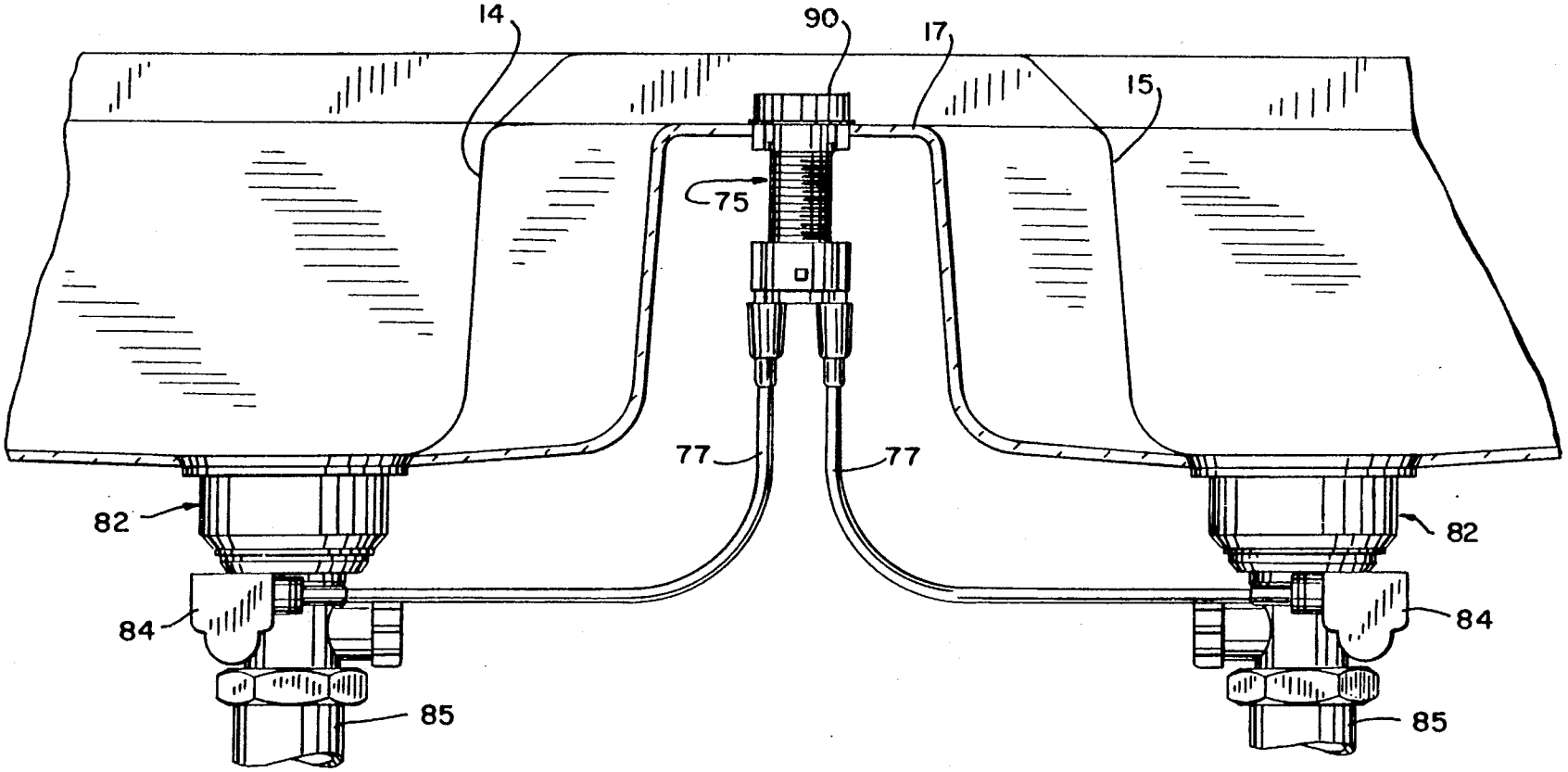
FIG. 8 is an elevational view and in partial section showing a drain control assembly for use with the waste storage assembly.

Referring to FIG. 8, a drain control assembly generally 75 is shown attached to the sink saddle portion 17. It includes the drain cables 77 connected to a strainer assembly 82 having an actuating mechanism 84 for opening and closing the drain. The usual drain pipes 85 are connected thereto. This particular drain control assembly is available from the Viega Company which is located in Attendorn, Germany. The drain control assembly is actuated by the control knob 90 which is positioned above the saddle portion 17. This, in conjunction with the chute 64 and the cover 66, provides a convenient accessibility to both the chute 64 as well as the drain control.

It is seen in conjunction with FIG. 1 that with the waste storage and removal assembly 10 positioned under the saddle portion 17, that no portions of the assembly are visible. This adds to its aesthetic features. Also it should be appreciated that the waste storage and removal assembly 10 is capable of right or left hand operation from under the sink 12 by merely reversing the placement of its component parts such as the hinge members 30 and 40, as well as the placement of the cut-a-way 63 for the skirt portion 61.

The drain control is such that a single control can control both sinks, thereby saving space so that a larger waste chute can be used. When using the sink, the cover is removed, and certain types of waste dropped through the chute into bucket 56. In view of the tight seal provided between the lip of the container 56 and the seal member 60, as well as the use of the odor absorbing material, any odor escaping the container during storage is kept to a minimum even during prolonged storage periods. When it is desired to empty the container, the cam member 45 is raised to the position shown in FIG. 4. This lowers the container away from the seal member 60, and the container is then pivoted to the outside of the sink cabinet 11 as shown in FIG. 6. After the container is emptied, the previous steps are reversed with the result that the container lip is again raised to tightly seal against the seal member 60.

While the waste removal assembly 10 has been shown in conjunction with a double basin sink, it is obvious that it can be utilized with a single basin sink and still provide the advantage of having a unit which in effect is a stand alone one which is easily placed under the cabinet of a sink unit. Also, it is not necessary that the waste removal assembly be utilized in conjunction with a drain control unit, nor that a provision be made for the placement of an odor absorbing material in the sealing hood 58.

Further, neither is it necessary that the leg members of the frame 23 be adjustable as it could be possible to make a height adjustment in the chute 64. A hood 58 with a seal member 60 has been illustrated as connected to the waste removal and storage assembly. If desired, the hood 58 and seal member 60 could be formed as part of chute 64. In addition, a threaded bearing nut can be used in place of the "E" clip 43. Therefore, the invention is not intended to be limited by the specific description or drawings of the preferred embodiments, but rather by the claims which follow.

I claim:

1. A support assembly for a waste container for use with a waste chute disposed under a sink, the waste chute having a sealing member comprising:

a first hinge member adapted to be connected to a frame structure;

a second hinge member;

a pintle having an essentially vertically oriented longitudinal axis;

said first and second hinge members being axially aligned with said pintle, means for connecting said second hinge member to said pintle in a rotatable manner, means for connecting said pintle to said first hinge member in an essentially vertically translatable manner;

a bearing surface connected to said first hinge member;

a cam member pivotally connected to said pintle and having a camming surface and an arm member with said camming surface operatively positioned on said bearing surface; and a support member connected to said second hinge member for supporting the waste container, said support member defined by an annular collar device;

whereby said waste container can be pivoted from positions outside and under said sink by said second hinge member rotating relative to said pintle as well as raised and lowered by means of said pintle being translated by said cam member to engage said sealing member of said waste chute.

2. The assembly of claim 1, wherein said bearing surface is provided by a spacer member positioned on said first hinge member.

3. The assembly of claim 1, wherein said frame structure is adapted to be secured in a sink cabinet.

4. The assembly of claim 1, wherein said second hinge member is formed from one continuous portion for connection with said pintle.

5. The assembly of claim 1, wherein said frame structure includes adjustable leg members.

6. The assembly of claim 1, wherein said support assembly further comprises means to limit inward and outward movement of said second hinge member.

7. A support assembly for a waste container for use with a waste chute disposed under a sink, the waste chute having a sealing member comprising:

a first hinge member adapted to be connected to a frame structure;

a second hinge member;

a pintle having an essentially vertically oriented longitudinal axis;

said first and second hinge members being axially aligned with said pintle, said second hinge member connected to said pintle in a rotatable manner, means for connecting said pintle to said first hinge member in an essentially vertically translatable manner;

a bearing surface connected to said first hinge member;

a cam member pivotally connected to said pintle and having a camming surface operatively positioned on said bearing surface; and a support member connected to said second hinge member for supporting the waste container, said support member defined by an annular collar device having an open bottom and at least one slot to accommodate a handle of said waste container;

whereby said waste container can be pivoted from positions outside and under said sink by said second hinge member as well as raised and lowered by means of said cam member to engage said sealing member of said waste chute.

8. A sink having a waste removal feature comprising:

a sink;

a waste chute disposed under said sink with the waste chute having a sealing member;

a waste storage and removal assembly including a frame structure connected to said sink;

a first hinge member connected to said frame structure;

a second hinge member;

a pintle having an essentially vertically oriented longitudinal axis;

said first and second hinge members coaxial with said pintle, said second hinge member connected to said pintle in a rotatable manner, means for connecting said pintle to said first hinge member in an essentially vertically translatable manner;

a bearing surface connected to said first hinge member;

a cam member pivotally connected to said pintle and having a camming surface operatively positioned on said bearing surface; and a support member connected to said second hinge member for supporting a waste container;

whereby said waste container can be pivoted from positions outside and under said sink by said second hinge member as well as raised and lowered by means of said cam member to engage said sealing member of said waste chute.

9. The assembly of claim 8, wherein said waste removal assembly is disposed completely in a cabinet under said sink.

10. The assembly of claim 8, wherein said sealing member is connected to a hood member.

11. The assembly of claim 8, wherein said frame structure is secured to a cabinet for said sink.

12. The assembly of claim 8, wherein said sink includes two sink basins with a saddle portion, said waste chute being connected to said saddle portion, and a drain control assembly for said sink basins connected to said saddle portion.

13. A waste storage assembly for use with a waste chute that is disposed under a sink, the assembly comprising:

a waste storage container having an upper lip;

a pintle having an essentially vertically oriented longitudinal axis;

means for pivoting the container around the pintle from a position where the container is directly under the chute to a second position where it is spaced laterally from the chute, means for connecting said pintle to the sink in an essentially vertically translatable manner; and a cam which is pivotally linked to the pintle to move the pintle along its longitudinal axis, said cam including an arm member;

whereby pivotal movement of the cam causes axial movement of the pintle, which in turn can move the container lip from a position in sealing engagement with the waste chute down to a lower position where the container may be pivoted around the pintle.

* * * * *